US010508563B2

(12) United States Patent
Cochet et al.

(10) Patent No.: US 10,508,563 B2
(45) Date of Patent: Dec. 17, 2019

(54) STATOR HEAT SHIELD SEGMENT FOR A GAS TURBINE POWER PLANT

(71) Applicant: ANSALDO ENERGIA SWITZERLAND AG, Baden (CH)

(72) Inventors: Magali Cochet, Brugg (CH); Andrey Sedlov, Moscow (RU); Maxim Plodistyy, Moscow (RU)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 154 days.

(21) Appl. No.: 15/727,112

(22) Filed: Oct. 6, 2017

(65) Prior Publication Data

US 2018/0100409 A1 Apr. 12, 2018

(30) Foreign Application Priority Data

Oct. 8, 2016 (EP) ..... 16192965

(51) Int. Cl.

| | |
|---|---|
| ***F01D 25/14*** | (2006.01) |
| ***F01D 25/12*** | (2006.01) |
| ***F01D 5/08*** | (2006.01) |
| ***F01D 11/24*** | (2006.01) |

(52) U.S. Cl.

CPC ..... *F01D 25/14* (2013.01); *F01D 5/085* (2013.01); *F01D 11/24* (2013.01); *F01D 25/12* (2013.01); *F05D 2240/81* (2013.01); *F05D 2250/75* (2013.01); *F05D 2260/201* (2013.01); *F05D 2260/231* (2013.01)

(58) Field of Classification Search

CPC ..... F01D 5/085; F01D 11/24; F01D 25/12; F01D 25/14; F05D 2240/81; F05D 2250/75; F05D 2260/201; F05D 2260/231

See application file for complete search history.

(56) References Cited

U.S. PATENT DOCUMENTS

| | | | |
|---|---|---|---|
| 4,573,865 A | 3/1986 | Hsia et al. | |
| 8,814,507 B1 * | 8/2014 | Campbell | F01D 5/08 415/173.1 |

(Continued)

FOREIGN PATENT DOCUMENTS

| | | |
|---|---|---|
| EP | 1 930 549 A2 | 6/2008 |
| EP | 2 894 301 A1 | 7/2015 |

OTHER PUBLICATIONS

Search Report dated Mar. 29, 2017, by the European Patent Office for Application No. 16192965.8.

*Primary Examiner* — Jason D Shanske
*Assistant Examiner* — Sang K Kim
(74) *Attorney, Agent, or Firm* — Buchanan Ingersoll & Rooney PC

(57) ABSTRACT

A stator heat shield segment for a gas turbine includes an inner surface facing a hot gas main flow of the gas turbine; an outer surface opposite to the inner surface and at least partially exposed to cooling air; a first impingement cavity provided with a plurality of first impingement holes fluidly connected with the cooling air supplied outside the outer surface; a feeding cavity isolated from the cooling air supplied outside the outer surface and fluidly connected with first impingement cavity; and a second impingement cavity provided with a plurality of second impingement holes fluidly connected to the feeding cavity.

15 Claims, 4 Drawing Sheets

(56) References Cited

U.S. PATENT DOCUMENTS

| | | | | |
|---|---|---|---|---|
| 2003/0131980 | A1* | 7/2003 | DeMarche | F01D 11/24<br>165/169 |
| 2008/0131264 | A1 | 6/2008 | Lee et al. | |
| 2013/0051972 | A1* | 2/2013 | Romanov | F01D 11/08<br>415/1 |
| 2016/0017750 | A1* | 1/2016 | Lefebvre | F01D 25/12<br>415/175 |

* cited by examiner

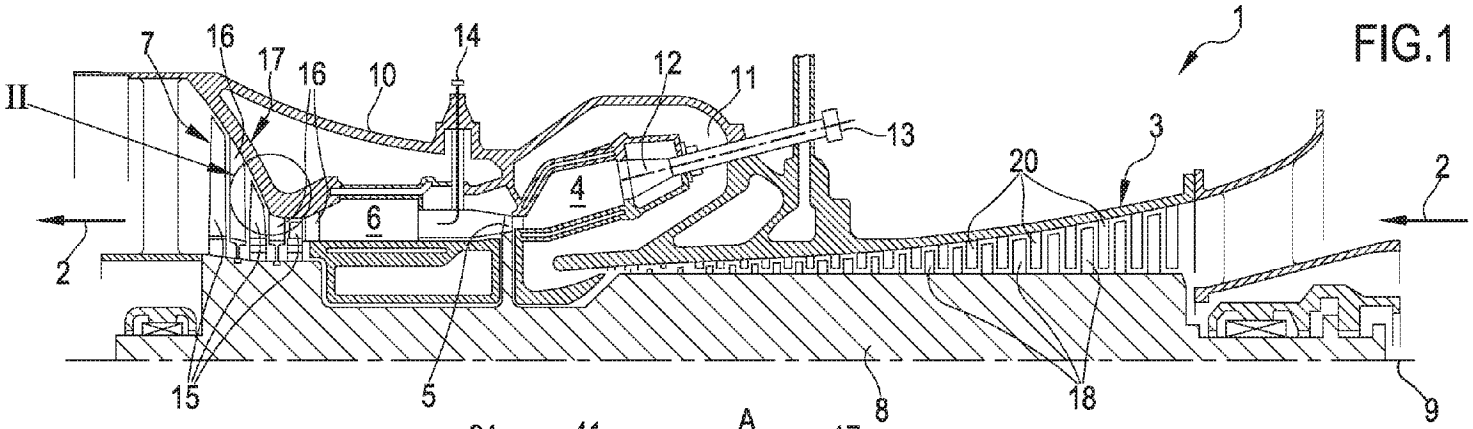
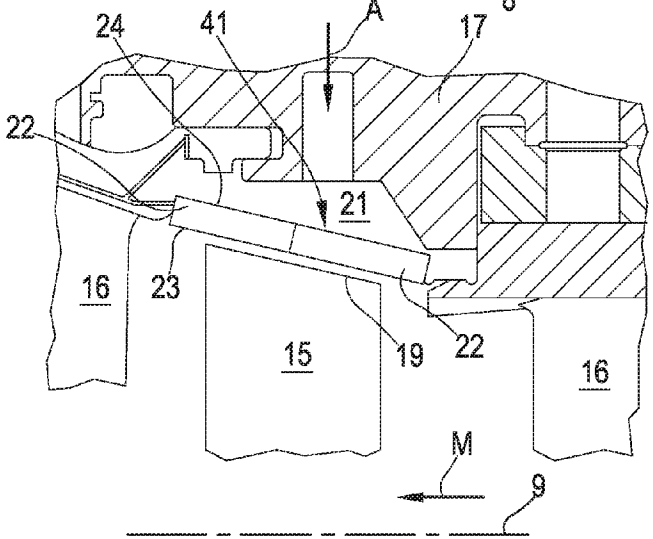
FIG.2

STATOR HEAT SHIELD SEGMENT FOR A GAS TURBINE POWER PLANT

PRIORITY CLAIM

This application claims priority from European Patent Application No. 16192965.8 filed on Oct. 8, 2016, the disclosure of which is incorporated by reference.

FIELD OF THE INVENTION

The present invention relates to a stator heat shield segment for a gas turbine power plant.

Moreover, the present invention relates to a stator heat shield comprising a plurality of such stator heat shield segments and to a gas turbine power plant comprising such stator heat shield.

DESCRIPTION OF PRIOR ART

As known, a gas turbine power plant (in the following only gas turbine) comprises a rotor provided with an upstream compressor, at least a combustion chamber and at least a downstream turbine. The terms downstream and upstream refer to the direction of the main gas flow passing through the gas turbine. In particular, the compressor comprises an inlet supplied with air and a plurality of blades that compress the air. The compressed air leaving the compressor flows into a plenum and from there into a burner. Inside the burner the compressed air is mixed with at least one fuel. The mixture of fuel and compressed air flows into a combustion chamber where this mixture are combusted. The resulting hot gas leaves the combustor chamber and is expanded in the turbine performing work on the rotor.

The turbine comprises a plurality of stages, or rows, of rotor blades that are interposed by a plurality of stages, or rows, of stator vanes. The rotor blades are connected to the rotor whereas the stator vanes are connected to a vane carrier that is a concentric casing surrounding the turbine.

At the tip of the rotor blades, the outer radial border for the hot gas flow is defined by a stator heat shield mounted on the vane carrier facing the blade tips. The stator heat shield comprises a plurality of stator heat shield segments, in form of tiles, arranged adjacent each other in the circumferential direction around the rotor as a ring.

The scope of the stator heat shield is to protect the vane carrier from exposure to the high temperature of the hot gas passing through the turbine. Therefore, the inner surface of the stator heat shield is facing the tip of the blades and is exposed to the hot gas. The terms inner and outer refer to the gas turbine axis.

In order to increase the lifetime of the stator heat shield, it is known provide the stator heat shields with cooling features. For instance, it is known to provide a cooling air at the outer surface of the stator heat shield.

However, the cooling of a stator heat shield, in particular the stator heat shield located at the first stage of turbine blades, is a very challenge task. Indeed, the cooling effectiveness is limited to convective cooling scheme, since film cooling of hot gas exposed surface is not applicable at area where the rotating blade passes facing the stator heat shield. This is for two reasons. Firstly, the complex flow field in the gap between stator heat shield and blade tip does not allow for cooling film development and resulted film effectiveness is very low and extremely hard to predict and measure. Secondly, in case of rubbing events the cooling openings are often closed preventing the cooling air outflow and therefore the lifetime of stator heat shield is significantly reduced.

Today there is the technical problem of increasing the lifetime of the stator heat shields further with a minimum coolant consumption in order to improve the gas turbine efficiency.

SUMMARY OF THE INVENTION

Accordingly, a primary purpose of the present invention is to provide an alternative stator heat shield segment suitable for overcoming the problem of the prior art foregoing mentioned.

In order to achieve the scope mentioned above, the present invention provides a stator heat shield for a gas turbine comprising a plurality of stator heat shield segments. In particular, each stator heat shield segment comprises:

an inner surface, preferably in form of a plate, facing the hot gas main flow passing through the turbine of the gas turbine;

an outer surface opposite to the inner surface and at least partially exposed to cooling air, preferably the outer surface is facing a plenum supplied with cooling air;

a first impingement cavity inwardly delimited by the inner surface and provided with a plurality of first impingement holes facing such inner surface; the first impingement cavity is fluidly connected with the cooling air supplied outside the outer surface;

a feeding cavity isolated from the cooling air supplied outside the outer surface and fluidly connected with the first impingement cavity; and a second impingement cavity inwardly delimited by the inner surface and provided with a plurality of second impingement holes facing such inner surface, the second impingement cavity is fluidly connected to the feeding cavity.

Advantageously, the above configuration realizes a double-staged impingement cooling scheme wherein the cooling air is used in cascade prior in the first impingement cavity and after in the second impingement cavity. Therefore, such double-staged impingement-cooling scheme allows a considerable cooling air reduction and ensures the maximum heat utilization of the relative gas turbine. Moreover, such double-staged impingement-cooling scheme ensures a uniform temperature of the cooled surface, namely the inner surface of the stator heat shield, in order to minimize the thermal stresses. In addition, the invention also eliminates the risk of failure in case of rub-through event.

In particular, the first and the second impingement cavity are arranged adjacent each other and parallel with respect to the inner surface and the turbine axis. The two adjacent impingement cavities are separated by a partition wall that may be provided with at least one cooling bypass hole in form of a through hole or a blind hole.

Advantageously, the above two-cascade impingement zones are parallel narrow cavities arranged along substantially the entire length, in axial direction, of the inner surface in order to allow an uniform cooling effect on the inner surface. Moreover, the at least one cooling bypass hole foregoing mentioned allows to cool the partition wall between the two adjacent impingement cavities.

In particular, the feeding cavity is arranged outwardly, or above, the second impingement cavity and outwardly, or above, a portion of the first impingement cavity next to the second impingement cavity.

Advantageously, the disposition of the feeding cavity outwardly, or above, the second impingement cavity allows the air flow to uniformly impinge the second impingement cavity passing through the second impingement holes.

In particular, the first impingement cavity and the feeding cavity may be a single common cavity S-shaped.

Advantageously, the above S-shaped disposition allows the entire inner surface of the first impingement cavity to be impinged by the cooling air passing through the first impingement holes.

In particular, according to an alternative embodiment of the S-shaped disposition above described, the first impingement cavity and the feeding cavity are separate cavities fluidly connected by at least an opening. The portion of the first impingement cavity facing such opening is provided with a plurality of flow barrier elements.

Advantageously, also the portion of the first impingement cavity not affected by the direct cooling impingement is cooled preventing any local cooling decreasing.

In particular, also the entire impinged surface of the first impingement cavity and of the second impingement cavity is provided with a plurality of flow barrier elements.

Advantageously, with such disposition the cooling effect is improved along substantially the entire impinged surface of the stator heat shield segment.

In particular, the above mentioned barrier elements comprise ribs, in form of simple ribs, V-ribs or W-ribs, pins, having circular or triangle section, or dimples.

In particular, the first impingement cavity and the second impingement cavity are laterally, i.e. in circumferential direction, closed by lateral walls.

Advantageously, since the first impingement cavity is independent with respect to the other cavities it is possible to adjust a single cavity individually, for instance providing a different number of impingement holes.

In particular, the feeding cavity is outwardly closed by a roof wall but is opened laterally, i.e. in circumferential direction, in order to connect such feeding cavity with the feeding cavity of the adjacent segments.

Advantageously, according to the above feature the feeding cavity acts as a large plenum covering the entire width in circumferential direction of the relative stator heat shield. This configuration allows to provide an uniform pressure to all second impingement cavities and, moreover, this large plenum reduces the risk of cooling underfeed in one particular second impingement cavity also in case of rub-through event.

The present invention refers also to a stator heat shield comprising a plurality of stator heat shield segments as foregoing described and to a gas turbine wherein provided with such stator heat shield.

In particular, the stator heat shield comprises a first series of the stator heat shield segments arranged adjacent in circumferential direction and a second series of the stator heat shield segments symmetrically arranged with respect to the first series in axial direction.

Preferably, the stator heat shield segments are realized by additive manufacturing methods, for instance by a selective laser melting method.

It is to be understood that both the foregoing general description and the following detailed description are exemplary, and are intended to provide further explanation of the invention as claimed. Other advantages and features of the invention will be apparent from the following description, drawings and claims.

The features of the invention believed to be novel are set forth with particularity in the appended claims.

BRIEF DESCRIPTION OF DRAWING

Further benefits and advantages of the present invention will become apparent after a careful reading of the detailed description with appropriate reference to the accompanying drawings.

The invention itself, however, may be best understood by reference to the following detailed description of the invention, which describes an exemplary embodiment of the invention, taken in conjunction with the accompanying drawings, in which:

FIG. 1 is a schematic sectional view of a gas turbine that can be provided with a stator heat shield according the invention;

FIG. 2 is an enlarged view of the portion indicated by II in the gas turbine of FIG. 1;

DETAILED DESCRIPTION OF THE INVENTION

Figure 3:
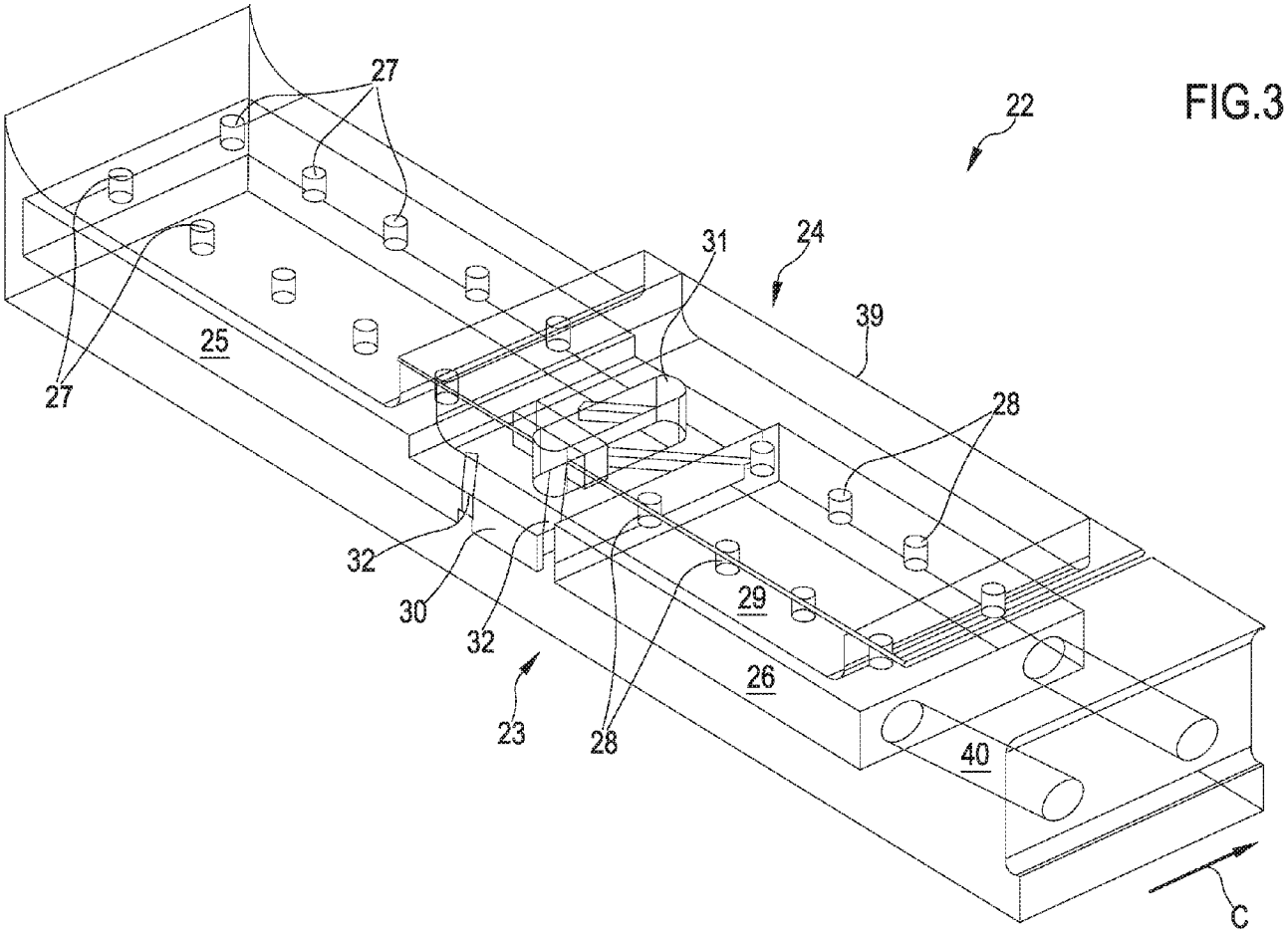
FIG. 3 is a schematic prospective view of an embodiment, represented partially see-through, of a stator heat shield segment according to the invention.

In cooperation with attached drawings, the technical contents and detailed description of the present invention are described thereinafter according to preferable embodiments, being not used to limit its executing scope. Any equivalent variation and modification made according to appended claims is all covered by the claims claimed by the present invention.

Reference will now be made to the drawing figures to describe the present invention in detail.

Reference is made to FIG. 1 that is a schematic view of an example of a gas turbine power plant 1 (in the following only gas turbine) that can be provided with a plurality of stator heat shield segments according to the invention. In particular, FIG. 1 discloses a gas turbine with sequential combustion.

Following the main gas flow 2, the gas turbine 1 comprises a compressor 3, a first combustion chamber 4, a high-pressure turbine 5, a second combustion chamber 6 and a low-pressure turbine 7. The compressor 3 and the two turbines 5, 7 are part of a common rotor 8 rotating around an axis 9 and surrounded by a concentric casing 10.

The compressor 3 is supplied with air and compresses it. The compressed air flows into a plenum 11 and from there into a premix burner 12 where this compressed air is mixed with at least one fuel introduced via a fuel supply 13. The fuel/compressed air mixture flows into the first combustion chamber 4 where this mixture are combusted.

The resulting hot gas leaves the first combustor chamber 4 and is partially expanded in the high-pressure turbine 5 performing work on the rotor 8.

Downstream of the low-pressure turbine 7 the gas partially expanded flows into the second combustion chamber 6 where fuel is injected via a fuel lance 14.

The partially expanded gas has a high temperature and contains sufficient oxygen for a further combustion that, based on a self-ignition, takes place in the second combustion chamber 6. The reheated gas leaves the second combustion chamber 6 and flows in the low-pressure turbine 7 where is expanded performing work on the rotor 8.

The low-pressure turbine 7 comprises a plurality of stages, or rows, of rotor blades 15 arranged in series in the main flow direction. Such stages of blades 15 are interposed by stages of stator vanes 16. The rotor blades 15 are connected to the rotor 8 whereas the stator vanes 16 are connected to a vane carrier 17 that is a concentric casing surrounding the low-pressure turbine 7.

Outwardly the rotor blades 15, the radial border for the hot gas flow is defined by a stator heat shield 41 mounted on the vane carrier 17 facing the blade tips 19 and arranged as ring along the circumferential direction with regard to the axis 9 of rotation of the rotor 8.

The stator heat shield 41 protects the vane carrier 17 from exposure to the high temperature of the hot gas passing through the turbine 7.

Reference is made to FIG. 2 that is an enlarged view of the portion indicated with II in FIG. 1. In particular, FIG. 2 discloses a turbine blade 15 interposed between two turbine vanes 16 connected to a vane carrier 17.

A stator heat shield 41 is schematically represented coupled to the vane carrier 17 and arranged outwardly the rotor blade 15 and axially between the two guide vanes 16. The stator heat shield 41 as shown in FIG. 2 separates the hot gas path of the gas turbine, which is indicated by an arrow M, from a cooling gas air indicated by an arrow A and supplied in a plenum 21 of the vane carrier 17.

Therefore, the inner surface 23 of the stator heat shield 41 is exposed to the hot gas, while the outer surface 24 is exposed to a cooling air.

As schematically disclosed in FIG. 2, the stator heat shield 41 comprises a plurality of stator heat shield segments 22. In particular, the sectional view of FIG. 2 discloses two stator heat shield segments 22 arranged adjacent each other along the axial direction.

Figures 4, 5, 6, 7A, 7B, 7C, 8A, 8B, 8C:
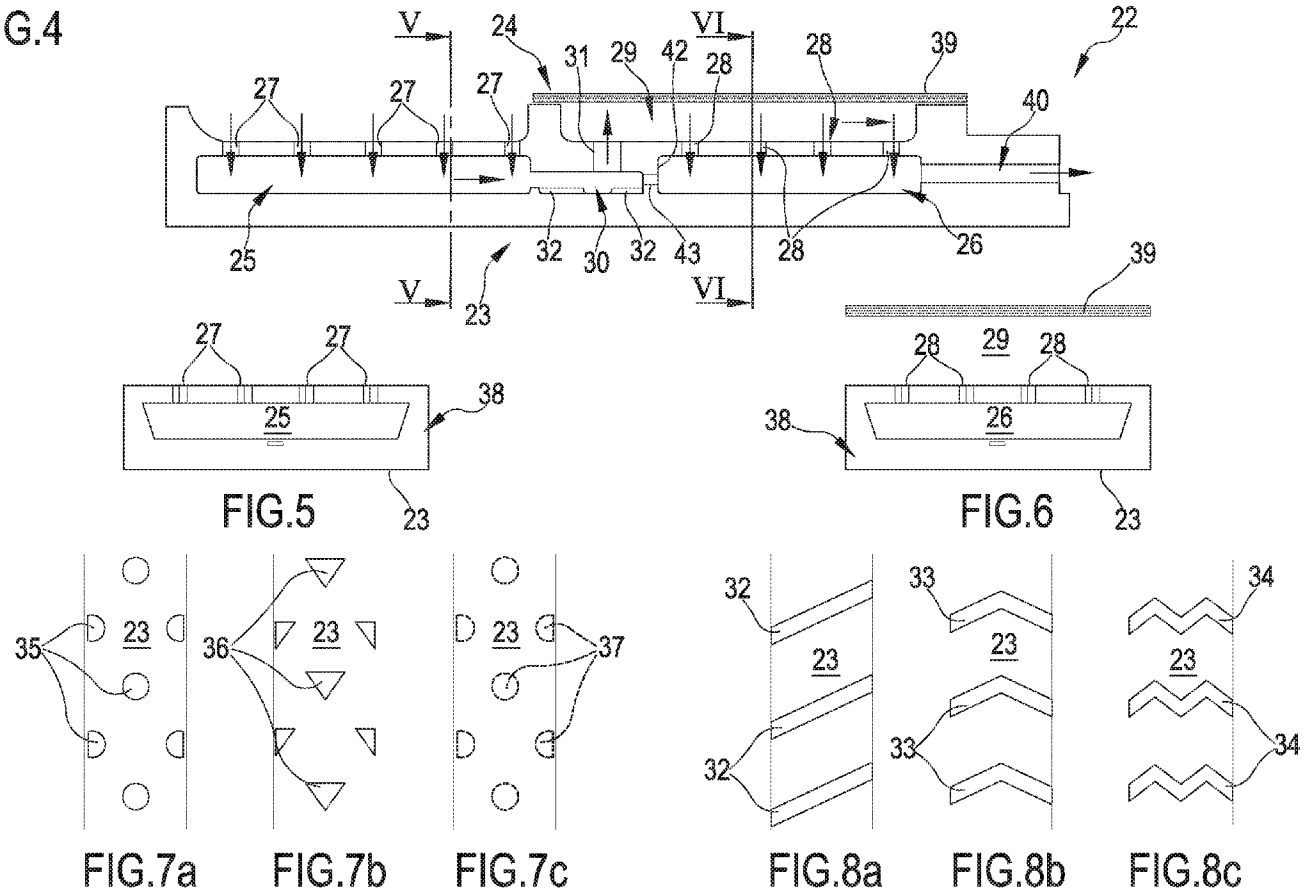
FIG. 4 is a schematic sectional view of the stator heat shield segment of FIG. 3.
FIGS. 5 and 6 are schematic sectional views of the stator heat shield segment of FIG. 4 respectively along the section lines V-V and VI-VI.
FIGS. 7*a*-7*c* and 8*a*-8*c* are schematic views of device for improving the cooling in the stator heat shield segment of FIG. 4.

Reference is made to FIGS. 3 and 4 that are schematic views of an embodiment of a stator heat shield segment 22 according to the invention. In particular, FIG. 3 is a schematic prospective view partially see-through and FIG. 4 is a schematic sectional view of the stator heat shield segment of FIG. 3.

The segment disclosed in FIGS. 3 and 4 can be considered as a tile element that has to be arranged adjacent to a plurality of similar stator heat shield segments in order to form a complete stator heat shield circumferential arranged as a ring around the axis 9 outwardly the blade tips 19.

According to the represented embodiment, each stator heat shield segment 22 comprises:

an inner surface 23, in form of a plate facing the hot gas main flow of the gas turbine; and an outer surface 24 opposite to the inner surface 23 and at least partially exposed to the cooling air.

Preferably, the outer surface 24 may be a stepped surface comprising a lower portion and an upper portion.

According to FIG. 4, inside each stator heat shield segment a plurality of cavities are realized. In particular, each stator heat shield segment 22 comprises a first impingement cavity 25 provided with a plurality of first impingement holes 27 facing the inner surface 23 and fluidly connected with the cooling air supplied outside the outer surface 24. Such first impingement cavity 25 is narrow and parallel to the inner surface 23 and is fluidly connected with a feeding cavity 29 isolated from the cooling air supplied outside the outer surface 24.

Each stator heat shield segment 22 comprises also a second impingement cavity 26 provided with a plurality of second impingement holes 28 facing the inner surface 23. This second impingement cavity 26 is adjacent to the first impingement cavity 25 and the two impingement cavities 25, 26 are separated by a partition wall 42 that, according to the embodiment of FIG. 4, is provided with a bypass cooling hole 43 in form of a through hole that allows to cool such partition wall 42. The second impingement cavity 26 is located inwardly, or below, with respect to the feeding cavity 29 and the second impingement holes 28 realize a fluid connection between the feeding cavity 29 and the second impingement cavity 26.

According to the embodiment of FIG. 4, the feeding cavity 29 is partially located outwardly, or above, a portion of the first impingement cavity 25. Such portion of the first impingement cavity 25 covered by the feeding cavity 29 is indicated in FIG. 4 by the reference 30. At such portion 30 of the first impingement cavity 25, the stator heat shield segment 22 comprises an opening 31 that fluidly connects the first impingement cavity 25 with the feeding cavity 29. As represented in FIG. 3, the opening 31 has substantially the same width, in circumferential direction, of the stator heat shield segment 22 whereas the impingement holes 27, 28 are configured to generate air flows substantially orthogonal to the inner surface 23.

According to the FIG. 4, at the portion 30 the first impingement cavity 25 comprises a plurality of ribs elements 32 in order to improve the cooling also in this region not directly impinged by the cooling air. FIG. 7*a*-8*c* discloses some alternative embodiments of the ribs 32 that can be applied not only at the region 30 but also along the entire impinged surface of the impingement cavities 25, 26, including the ribs 33, 34, pins 35, 36 or dimples 37.

Reference is made to the FIGS. 5 and 6 that are schematic sectional views of the stator heat shield segment of FIG. 4 respectively along the section lines V-V and VI-VI.

In particular, FIG. 5 discloses the lateral walls 38 of the first impingement cavity 25 that is therefore independent from the other cavities.

FIG. 6 discloses the lateral walls 38 of the second impingement cavity 26, which is therefore independent as the first impingement cavity 25, and the roof wall 39 of the feeding cavity 29. According to FIG. 6, the feeding cavity 29 is not provided with lateral walls in circumferential direction in order to define with adjacent segments a large and common plenum located outwardly, or above, the second impingement cavity 26.

Finally, the cooling air flow leaves the second impingement cavity 26 passing through a lateral outlet in form of discharge holes 40.

Figure 9:
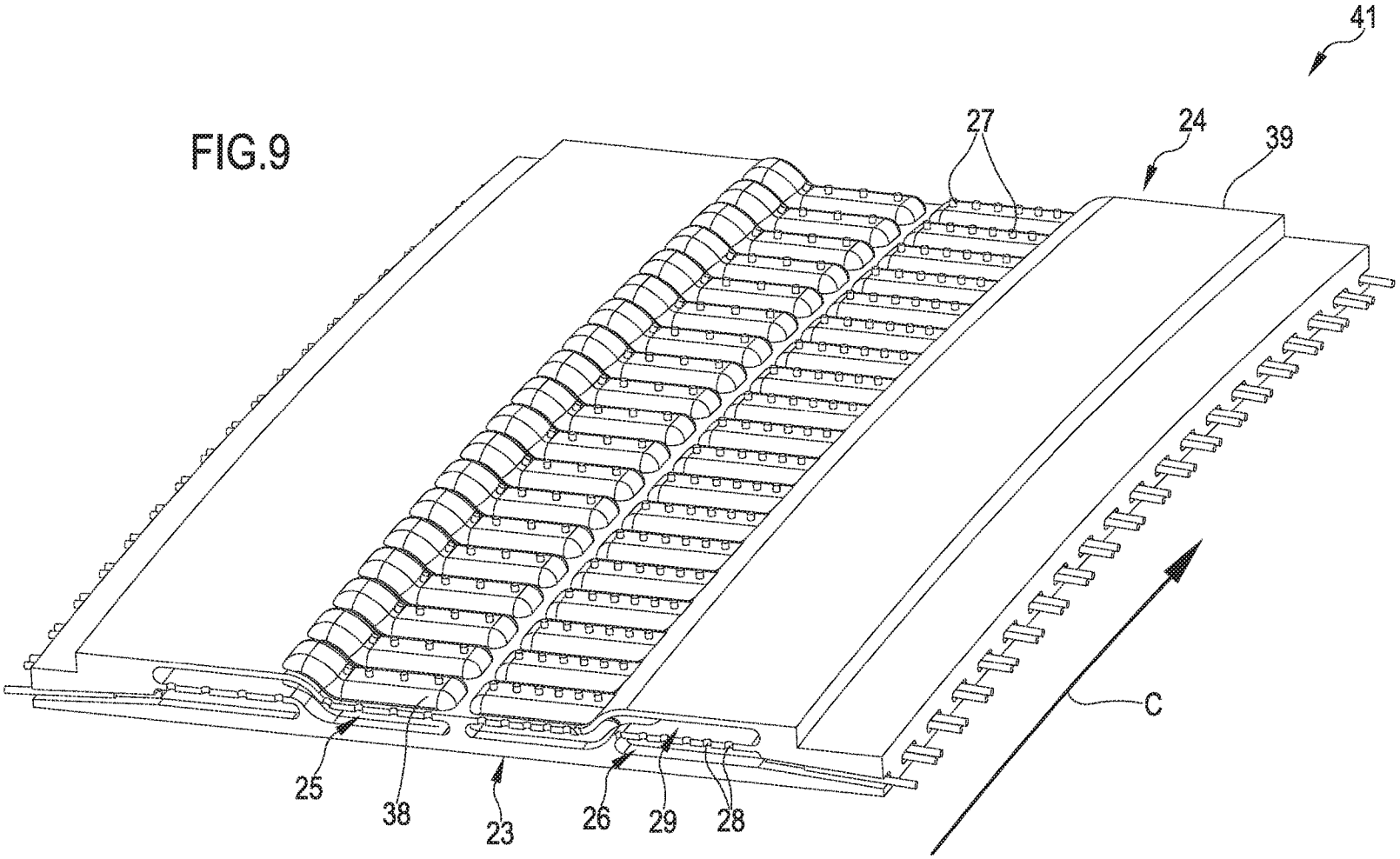
FIG. 9 is a partial schematic prospective view of a stator heat shield comprising a plurality of stator heat shield segments according the invention.

Reference is made to the FIG. 9 that is a partial schematic prospective view of a stator heat shield 41 comprising a plurality of stator heat shield segments 22 according the invention.

According to this embodiment of the invention, the stator heat shield 41 comprises a first series of the stator heat shield segments 22 arranged adjacent each other as a ring along the circumferential direction. In this configuration, the feeding cavity 29 acts as a large plenum covering the entire width the stator heat shield 41 along the circumferential direction C. Moreover, the stator heat shield 41 of FIG. 9 comprises a second series of the stator heat shield segments 22 symmetrically arranged with respect to the first series along the axial direction.

With respect to the embodiment of FIGS. 3 and 4, the first cavity 25 and the feeding cavity 29 of FIG. 9 are shaped as a unique common cavity having a S section. Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A stator heat shield segment for a gas turbine, the stator heat shield segment comprising:

an inner surface for facing a hot gas main flow path of the gas turbine;

an outer surface opposite to the inner surface and configured for at least partial exposure to cooling air;

a first impingement cavity provided with a plurality of first impingement holes for being fluidly connected with cooling air supplied outside the outer surface;

a feeding cavity isolated from a path of cooling air to be supplied outside the outer surface and fluidly connected with first impingement cavity; and a second impingement cavity provided with a plurality of second impingement holes and being fluidly connected to the feeding cavity, wherein the first impingement cavity and the second impingement cavity are laterally closed by lateral walls.

2. Segment as claimed in claim 1, wherein the first and the second impingement cavities are arranged beside one another in parallel with respect to the inner surface and are separated by a partition wall.

3. Segment as claimed in claim 2, wherein the partition wall comprises:

at least a bypass cooling hole.

4. Segment as claimed in claim 2, wherein the feeding cavity is arranged above the second impingement cavity and above a portion of the first impingement cavity next to the second impingement cavity.

5. Segment as claimed in claim 4, wherein the first impingement cavity and the feeding cavity are a common cavity which is S-shaped.

6. Segment as claimed in claim 4, wherein the first impingement cavity and the feeding cavity are fluidly connected through at least an opening, the inner surface of the first impingement cavity facing the opening includes a first plurality of flow barrier elements.

7. Segment as claimed in claim 6, wherein inner surfaces of the second impingement cavity includes a second plurality of flow barrier elements.

8. Segment as claimed in claim 7, wherein the first and second plurality of flow barrier elements comprise: at least one of ribs or pins, or dimples.

9. Segment as claimed in claim 1, wherein the feeding cavity is closed above by a roof wall and laterally is opened and connected to an adjacent segment.

10. Segment as claimed in claim 1, comprising:

discharge holes fluidly connected to the second impingement cavity.

11. Segment as claimed in claim 1, comprising:

additively manufactured material.

12. A stator heat shield comprising:

a plurality of stator heat shield segments as claimed in claim 1.

13. The stator heat shield as claimed in claim 12, comprising:

a first series of the plurality of stator heat shield segments which are arranged to be laterally adjacent to one another.

14. The stator heat shield as claimed in claim 13, comprising:

a second series of the plurality of stator heat shield segments which are symmetrically arranged with respect to the first series.

15. A gas turbine energy plant comprising:

a rotor;

a compressor;

at least one combustion chamber; and a gas turbine provided with a plurality of row of blades, supported by the rotor, interposed by a plurality of vanes supported by a vane carrier, wherein the vane carrier includes at least the stator heat shield as claimed in claim 12.

* * * * *